United States Patent [19]

Keller

[11] Patent Number: 4,782,560

[45] Date of Patent: Nov. 8, 1988

[54] TASSEL STRUCTURE

[75] Inventor: Gary E. Keller, Mesa, Ariz.

[73] Assignee: Karsten Manufacturing Corporation, Phoenix, Ariz.

[21] Appl. No.: 61,804

[22] Filed: Jun. 15, 1987

[51] Int. Cl.[4] ..... F16G 11/00

[52] U.S. Cl. ..... 24/136 L; 24/115 M; 24/117

[58] Field of Search ..... 24/115 M, 117, 136 R, 24/136 L, 266, 462, 595, 634; 403/211, 213; 16/122

[56] References Cited

U.S. PATENT DOCUMENTS

| | | | |
|---|---|---|---|
| 515,155 | 2/1894 | Nelson | 24/136 L |
| 1,200,012 | 10/1916 | Oldham | 24/136 L |
| 3,086,267 | 4/1963 | Mathes | 24/117 R |
| 4,112,551 | 9/1978 | Sales | 24/136 L X |
| 4,680,835 | 7/1987 | Horng | 24/117 |

FOREIGN PATENT DOCUMENTS

| | | | |
|---|---|---|---|
| 1171802 | 6/1964 | Fed. Rep. of Germany | 403/211 |
| 2418880 | 10/1975 | Fed. Rep. of Germany | 403/211 |
| 19754 | 9/1905 | United Kingdom | 403/211 |

*Primary Examiner*—Kenneth J. Dorner
*Assistant Examiner*—Laurie K. Cranmer
*Attorney, Agent, or Firm*—Herbert E. Haynes, Jr.

[57] ABSTRACT

A tassel for joining the ends of a draw cord of the type used for closing of a fabric bag, or optionally for mounting on the end of a pull cord of the type used for operating a lamp. The tassel includes a shell having a downwardly opening cavity with a cord end or ends receiving aperture formed through the top. A plug is demountably carried in the cavity of the shell and cord gripping elements are formed in the shell and on the plug for frictionally holding the cord end or ends in the tassel structure.

21 Claims, 1 Drawing Sheet

TASSEL STRUCTURE

BACKGROUND OF THE INVENTION

1. Field of the Invention

This invention relates in general to tassels and more particularly to a tassel structure for mounting on the end of a pull cord or for joining the ends of a draw cord.

2. Description of the Prior Art

The depending terminal ends of pull cords are usually provided with a tassel of some sort which serves two purposes, namely to provide some weight to keep the cord hanging straight down and to keep the cord from unraveling. In addition to these two functional purposes, tassels are sometimes used for decorative reasons.

In some cases such as in the pull cords of lamps, tassels are often formed by a plurality of even length threads which are looped over and tied about an enlargement, such as a knot, formed on the depending end of the pull cord so that the threads dangle from the end of the pull cord. Such tassels are mainly decorative in that they are rather light in weight and cannot withstand large pulling forces. For these reasons, thread-type tassels are usually used in what may be described as light-duty applications.

The tassels used on the depending ends of pull cords such as of the type used for opening and closing drapes, are heavier than the above discussed thread-type decorative tassels and are therefore better suited for longer pull cords. Such tassels usually are in a generally conical shape having a bore, an open bottom and an aperture formed in the upper end. The depending end of the pull cord is threaded downwardly through the aperture and knotted so that the knot will be located in the bore of the tassel to prevent the cord from being pulled back out of the aperture of the tassel.

The two general types of pull cord tassels discussed above have a common limitation in that neither one of them can be used to join the ends of a draw cord of the type commonly used for closing the open top of fabric bags. Fabric bags of the type used for containing shoes, laundry, and various other articles, are often provided with a single length of a draw cord which passes through a loop-like structure formed about its open top end. The opposite ends of the draw cord which extend from the loop-like structure, are sometimes individually knotted to prevent unraveling and to keep the draw cord from unintentionally being pulled out of the loop-like structure. Preferably, however, the two ends of the draw cord are joined together for the same reasons and to simplify the use thereof by eliminating the need for a user to place and hold the cord ends in a side-by-side position prior to each closing of the bag. Such joining of the opposite ends of a draw cord is usually accomplished by tying the ends together in a single knot, and in the cases of draw cords formed of synthetic materials, the knot is heated to melt the knot enough to permanently hold the knot in the tied position. While knotted joining of the ends of a draw cord accomplishes the intended purposes, it is not aesthetically appealing and many people feel that it presents an unsightly and unfinished look to what may otherwise be a very attractive product. Further, the melting of synthetic materials in the area of the knotted ends of the cord as discussed above, causes the melted knot to become very hard and jagged which can hurt and sometimes cut a user's hand.

To the best of my knowledge, no tassel structure for joining the ends of a draw cord is available and further, no such tassel is available for optional use in either joining the ends of a draw cord or on the depending end of a pull cord. Therefore, a need exists for a new and useful tassel structure which overcomes some of the shortcomings of the prior art.

SUMMARY OF THE INVENTION

In accordance with the present invention, a new and useful tassel structure is disclosed for the primary purpose of joining the ends of a draw cord of the type commonly used for closing the open top of a fabric bag. Alternatively, the tassel can be mounted on the depending end of a pull cord to prevent unraveling thereof and to provide a weighted end for holding the pull cord in a straight hanging attitude. Further, the tassel structure adds aesthetic appeal to whatever article or product is it used on.

The tassel structure includes a shell which is preferably of frusto-conical configuration and defines a cavity with an open bottom end. An axial aperture for receiving the cord end or ends, is formed in the top of the shell so as to open downwardly into the cavity defined thereby. The cavity of the shell is also preferably of frusto-conical configuration for receiving a locking plug of similar shape which is inserted into the cavity through the open bottom end of the shell.

The shell and locking plug are formed with cooperating elements of a cord gripping means which interact to frictionally retain the end or ends of the cord within the tassel structure. The shell and locking plug are also provided with a latching means by which the locking plug is demountably held in the cavity of the shell.

The bottom, or base of the locking plug is configured so that a disc may be mounted thereon. The disc is preferably used to provide the tassel structure with a finished appearance and provide a smooth surface for displaying suitable indicia such as a company name, logo, or the like.

Accordingly, it is an object of the present invention to provide a new and improved tassel structure.

Another object of the present invention is to provide a new and improved tassel structure which may be used on the single end of a pull cord or for joining the ends of a draw cord.

Another object of the present invention is to provide a new and improved tassel structure of the above described character which includes a shell and a locking plug which are cooperatively interacted to frictionally attach the tassel structure to the end or ends of the cord to which it is to be attached.

Another object of the present invention is to provide a new and improved tassel structure of the above described type wherein the locking plug is demountably carried in a cavity defined by the shell to permit disassembly of the tassel-cord assembly for cord replacement purposes.

Still another object of the present invention is to provide a new and improved tassel structure of the above described character which further includes a disc for mounting on the base of the locking plug for providing the tassel structure with a finished aesthetically appealing look and to proivide a suitable surface for displaying indicia.

The foregoing and other objects of the present invention as well as the invention itself, may be more fully understood from the following description when read in conjunction with the accompanying drawings.

DESCRIPTION OF THE PREFERRED EMBODIMENT

Figure 1:
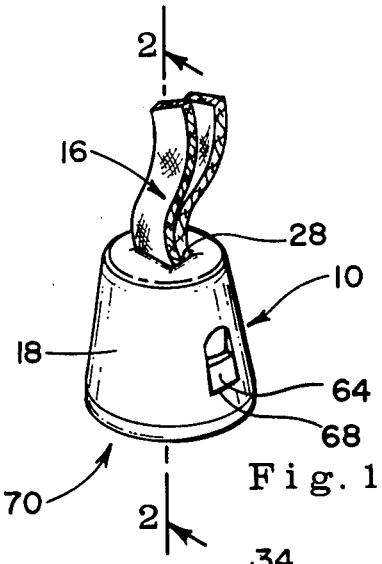
FIG. 1 is a perspective view of the tassel structure of the present invention and showing the tassel structure as being mounted on the ends of a draw cord.

Referring more particularly to the drawings, wherein the tassel structure of the present invention, which is indicated in its entirety by the reference numeral 10, is shown as being mounted on the ends 12 and 14 of a draw cord 16. As will hereinafter be described, the illustrated draw cord 16 is intended to be indicative of draw cords and pull cords of different types and is not intended as being a limitation of the present invention.

The tassel 10 includes an outer shell 18 which is preferably of frusto-conical configuration of circular cross section with an endless side wall 22 having a downwardly increasing diameter. The shell 18 defines a cavity 24 having an axially open bottom 26, with the cavity being surrounded by the endless side wall 22 of the shell 18 so that the cavity is similarly of frusto-conical configuration. The shell 18 is provided with an axial aperture 28 in its top wall 30 with the aperture opening downwardly into the cavity 24 defined by the shell. A pair of ribs 32 and 34 depend integrally from the top wall 30 of the shell on opposite sides of the aperture 28. Those ribs 32 and 34 provide a wedge-shaped downwardly opening socket 36 between the rib 32 and the adjacentportion of the shell's side wall 22 and a similar socket 38 between the opposed rib 34 and that portion of the shell's side wall 22 which is adjacent thereto.

The tassel structure 10 further includes a locking plug 40 which is configured in a generally frusto-conical shape for insertion into the cavity 24 of the shell 18 through the open bottom end 26 thereof. The top end of the locking plug 40 is provided with a saddle means thereon which includes an elongated upstanding ridge 42 that lies on a diameter of the top end of the plug. A pair of elongated wedge-shaped projection members 44 and 46 are formed integrally with the plug 40 so as to extend upwardly from the top thereof. The wedges 44 and 46 are parallel with respect to the central ridge 42 and are disposed in opposite and spaced relationship with the central ridge. A first upwardly opening pocket 48 is provided between the upstanding wedge 44 and the central ridge 42 and a second similar pocket 50 is located between the opposed wedge 46 and the ridge 42.

As will hereinafter be described in detail, the depending ribs 32 and 34 and the sockets 36 and 38 of the shell 18, the wedges 44 and 46 and the pockets 48 and 50 and the central ridge 42, form what may be described as the cooperating elements of a cord gripping means for frictionally mounting the cord 16 in the tassel structure 10.

Figure 2:
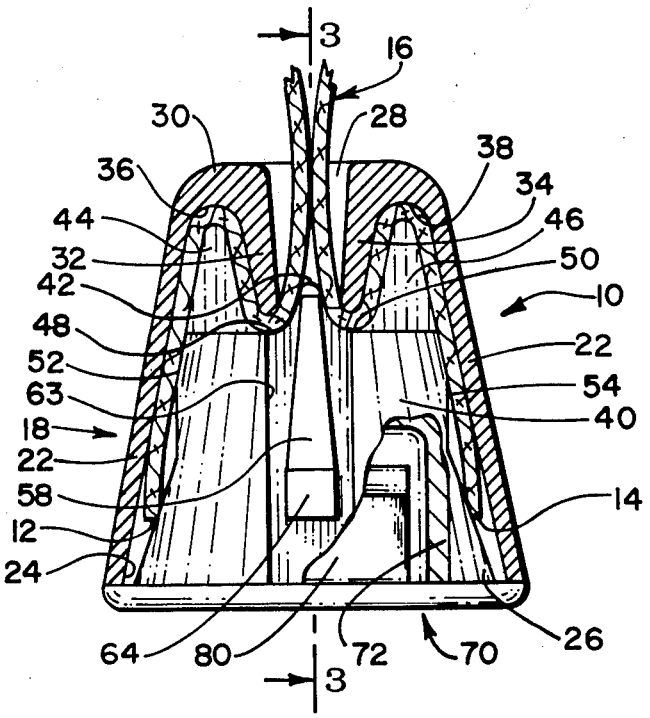
FIG. 2 is an enlarged sectional view taken along the line 2—2 of FIG. 1.

Frictional attachment of the tassel structure 10 to the draw cord 16 is accomplished by placing the ends 12 and 14 of the draw cord in the cavity 24 by threadingly passing them downwardly through the aperture 28 of the shell 18. Manual separation of the draw cord ends 12 and 14 is then accomplished so as to locate the locking plug 40 between the separated ends. The plug 40 is then pushed into the cavity 24 of the shell 18 to bring the cooperating elements of the cord gripping means into frictional engagement with the ends 12 and 14 of the draw cord. As shown in FIG. 2, the cord end 12 is disposed in an upwardly opening loop in the pocket 42 of the locking plug 40 and is frictionally held therein by the depending rib 32 of the shell 18. That same cord end 12 is further disposed in a downwardly opening loop in the socket 36 of the shell 18 and is frictionally held therein by the wedge 44 of the plug 40. Similarly, the other end 14 of the cord is held in the pocket 50 of the plug 40 by the rib 34 of the shell 18 and is additionally held in the socket 38 of the shell 18 by the upstanding wedge 46 of the plug 40.

Therefore, each of the ends 12 and 14 are frictionally gripped in two separate locations within the tassel structure 10 and one of those gripping functions is accomplished by a wedging action, i.e., the sockets 36, 38 and the wedge members 44 and 46. In this manner, the tassel structure 10 is firmly and positively mounted on the ends of the draw cord 16.

Figure 4:
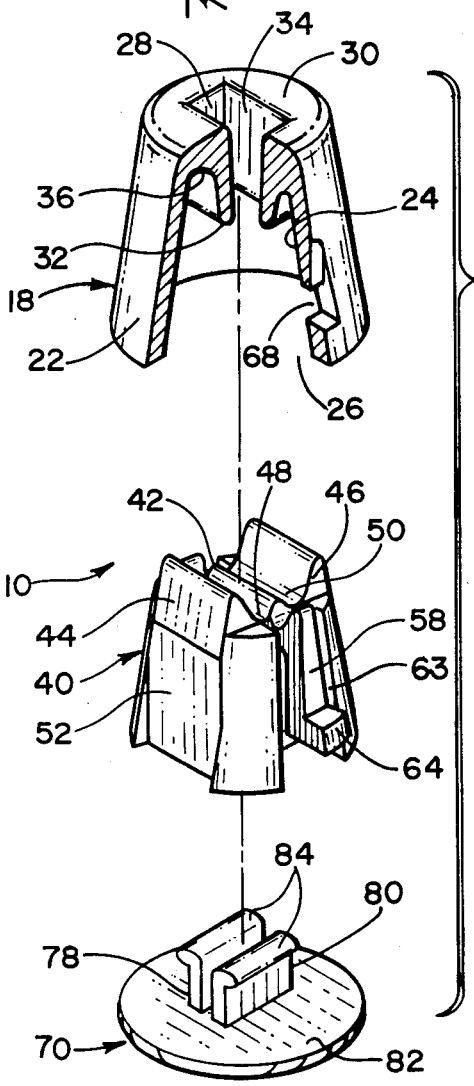
FIG. 4 is an exploded perspective view of the various components which form the tassel structure of the present invention.

As seen best in FIGS. 2 and 4, the locking plug 40 is formed with flats 52 and 54 which extend downwardly from the outer surfaces of the wedges 44 and 46, respectively. Those flats 52 and 54 provide sufficient room for the ends 12 and 14 of the draw cord 16 to be disposed between the flats and the adjacent portions of the side wall 22 of the shell. This provides a still further frictional gripping of the cord ends 12 and 14 which are pinched between the plug 40 and the shell 18 by another wedging action.

Although the draw cord 16 is shown as being of flat configuration, and the aperture 28 of the shell is shown as being of matching shape, it will be understood that the draw cord 16 could just as well be of circular cross section. In such a case, the aperture 28 could be of circular cross section to match the cord, and the various dimensional relationships between the shell 18 and the plug 40 could be altered to suit the diameter of whatever size draw cord is to be used.

Further, it will be understood that the above described tassel structure 10 can be mounted on the single end of a pull cord (not shown). This can be accomplished by locating the single end of the pull cord in the same manner as either one of the ends 12 and 14 of the draw cord 16 in the tassel structure 10 so that that single end is frictionally gripped thereby. In order to keep the plug 40 properly centered in the shell 18 and thereby produce the desired gripping forces, a suitable shim (not shown), such as a short piece of cord, can be located between the unoccupied flat 52 or 54, and the side wall of the shell.

Figure 3:
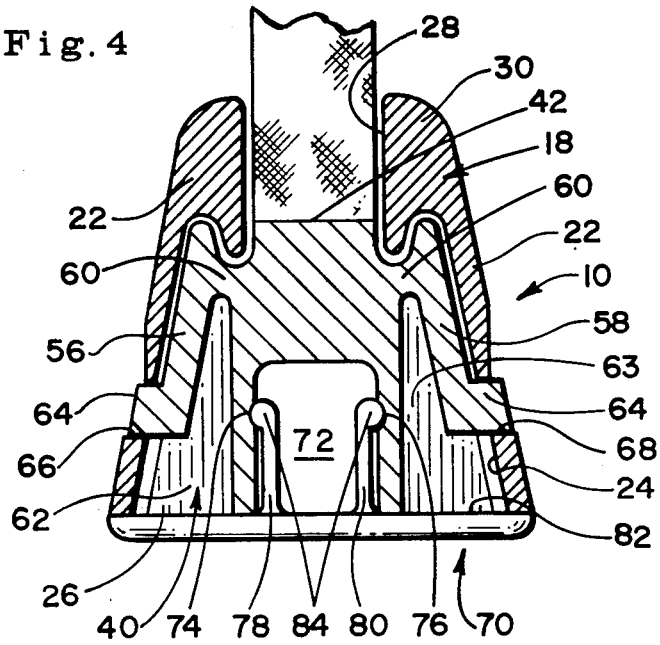
FIG. 3 is a sectional view taken along the line 3—3 of FIG. 2.

The tassel structure 10 further includes a latching means by which the locking plug 40 is demountably held in the cavity 24 of the shell. The latching means includes a pair of spring arms 56 and 58 which are integral with the plug 40 and are disposed on diametrically opposed sides thereof. The arms 56 and 58 are attached at their upper ends as indicated at 60 in FIG. 3, and depend from the attachment point 60 within grooves 62 and 63 formed in the plug 40. Each of the spring arms 56 and 58 have an enlargement, or button 64 formed integrally thereon so as to extend laterally from the plug 40. The shell 18 is formed with openings 66 and 68 in diametrically opposed portions of the side wall 22 thereof.

When the plug 40 is being inserted into the cavity 24 of the shell 18, the inwardly facing surface of the shell's side wall 22 will bear against the buttons 64 of the spring arms 56 and 58 to deflect them inwardly. When the plug 40 reaches the fully inserted position, the resilient nature of the spring arms will move them back to their normal positions wherein the buttons 64 will move into the aligned openings 66 and 68 of the shell 18 thereby accomplishing the latched mounting of the plug 40 in the shell 18.

Since the openings 66 and 68 of the shell 18 are formed through the side wall 22, manual depressing of the buttons 64 of the arms 56 and 58 will move the arms to their inwardly deflected positions to release the plug 40 from its latched and inserted position. Thus, the plug 40 is demountable to allow the tassel structure to be taken apart for cord replacement or changing purposes.

Due to the grooves 62 and 63 of the plug 40 and the various spaces between the plug 40 and the shell 18, the bottom of the tassel structure 10 will be uneven and have a somewhat unfinished appearance. For this reason, and to provide a suitable surface for displaying indicia such as advertising material, a company logo, and the like, a disc 70 is preferably included with the tassel structure 10. The disc 70 may be attached in any suitable manner such as by using a suitable adhesive for gluing the disc directly to the base of the plug 40. In the illustrated embodiment, the plug 40 is formed with a blind bore 72 that opens downwardly onto the base thereof, and grooves 74 and 76 are provided in the side walls which define the bore. The disc 70 is formed with a spaced apart pair of arms 78 and 80 which extend upwardly and normally from the inner surface 82 of the disc. The arms 78 and 80 each have a ledge 84 formed thereon which snap into the aligned grooves 74 and 76 of the plug 40 to demountably attach the disc to the base of the plug 40.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A tassel structure for joining the ends of a cord means comprising:

(a) a shell having a top and an endless side wall which define a cavity, said shell having an open bottom and an aperture formed through the top thereof for receiving the ends of the cord means;

(b) a plug for linearly pushed insertion into the cavity of said shell through the open bottom thereof;

(c) cooperating elements of a cord gripping means formed in said shell and on said plug for frictionally gripping the ends of the cord means, said cooperating elements including, I. said plug having upwardly opening pocket means means formed in the top thereof, II. said shell having rib means depending from the top into the cavity thereof, said rib means being alignigly disposed in said pocket means of said plug for frictionally holding the ends of the cord means in said pocket means of said plug; and (d) a disc mounted on the bottom of said plug for covering the bottom of said plug and the bottom of said shell.

2. A tassel structure as claimed in claim 1 and further comprising releasable latching means for demountably holding said plug in the inserted position within the cavity of said shell.

3. A tassel structure as claimed in claim 1 wherein said cooperating elements of a cord gripping means further comprises:

(a) said shell having socket means formed in the top thereof so as to open downwardly into the cavity defined thereby; and (b) upstanding projection member means formed on the top of said plug, said projection member means being alignigly disposed in said socket means of said shell for frictionally holding the ends of the cord means in said socket means of said shell.

4. A tassel structure as claimed in claim 3 wherein said socket means of said shell and said projection member means of said plug are wedge shaped.

5. A tassel structure as claimed in claim 1 wherein said cooperating elements of a cord gripping means further comprises:

(a) said rib means of said shell being in the form of a pair of ribs depending from the top into the cavity thereof, said pair of ribs being disposed on opposite sides of the aperture formed through the top of said shell and cooperating with adjacent portions of the side wall of said shell to provide a pair of sockets which open downwardly into the cavity of said shell;

(b) said pocket means of said plug being in the form of an upstanding central ridge and a pair of upstanding projection members disposed on opposite sides and in spaced relationship with the central ridge to provide a pair of pockets on opposite sides of the ridge;

(c) said depending ribs on said shell being alignigly disposed in the pockets of said plug for frictionally holding a first portion of each of the ends of the cord in different ones of said pair of pockets of said plug; and (d) said upstanding projection members of said plug being alignigly disposed in said sockets of said shell for frictionally holding a second portion of each of the ends of the cord in different ones of said pair of sockets of said shell.

6. A tassel as claimed in claim 5 and further comprising said plug being configured to provide a pair of spaces between opposite sides of said plug and the adjacent portions of the side wall of said shell for frictionally holding a third portion of each of the ends of the cord in different ones of said pair of spaces.

7. A tassel structure for joining the opposite ends of a draw cord comprising:

(a) a shell having a top and an endless side wall which defines a cavity of frusto-conical configuration, said shell having an open bottom and an aperture formed axially through the top thereof for receiving the ends of the draw cord;

(b) a plug having a top and a bottom, said plug being of frusto-conical configuration for linearly pushed insertion into the cavity of said shell through the open bottom thereof;

(c) cooperating elements of a cord gripping means formed in said shell and on said plug for frictionally gripping the ends of the draw cord, said cooperating elements including, I. said shell having socket means formed by a pair of ribs which depend from the top into the cavity of said shell, said pair of ribs being disposed on opposite sides of the aperture formed through the top of said shell and cooperating with adjacent portions of the side wall of said shell to provide a pair of sockets which provide said socket means of said shell, II. said plug having an upstanding central ridge on its top and an upstanding projection member means in the form of a pair of upstanding projection members on opposite sides and in spaced relationship with the central ridge to provide a pair of pockets on opposite sides of the ridge;

(d) each of said pair of ribs on said shell being aligningly disposed in different ones of said pair of pockets of said plug for frictionally holding a first portion of each of the ends of the draw cord in different ones of said pair of pockets of said plug;

(e) each of said pair of projection members of said plug being aligningly disposed in different ones of said pair of sockets of said shell for frictionally holding a second portion of each of the ends of the draw cord in different ones of said pair of sockets of said shell; and (f) said plug being formed with a pair of flats on diametrically opposed sides thereof to provide a pair of spaces between said flats of said plug and the adjacent portions of the side wall of said shell for frictionally wedging a third portion of each of the ends of the draw cord in different ones of said pair of spaces.

8. A tassel structure as claimed in claim 7 and further comprising releasable latching means formed in said shell and on said plug for demountably holding said plug in the inserted position within the cavity of said shell.

9. A tassel structure as claimed in claim 8 wherein said latching means comprises:

(a) said shell having a pair of openings formed in diametrically opposed locations in the side wall thereof; and (b) a pair of spring arms formed on diametrically opposed sides of said plug, each of said spring arms having a button-like enlargement extending therefrom, said pair of spring arms having normal positions wherein said button-like enlargements are located in different ones of the openings of said shell for holding said plug in said shell and having deflected positions wherein said button-like enlargements are free of the openings of said shell.

10. A tassel structure for joining the opposite ends of a draw cord comprising:

(a) a shell having a top and an endless side wall which define a cavity of frusto-conical configuration, said shell having an open bottom and an aperture formed axially through the top thereof for receiving the ends of the draw cord;

(b) a plug having a top and a bottom and being of frusto-conical configuration for linearly pushed insertion into the cavity of said shell through the open bottom thereof;

(c) cooperating elements of a cord gripping means formed in said shell and on said plug for frictionally gripping the ends of the draw cord, said cooperating elements including, I. said shell having socket means formed in the top thereof so as to open downwardly into the cavity defined thereby, II. upstanding projection member means formed on the top of said plug, said projection member means being aligningly disposed in said socket means of said shell for frictionally holding the ends of the draw cord in said socket means of said shell; and (d) a disc of planar configuration mounted on the bottom of said plug for covering the bottom of said plug and the bottom of said shell and to provide a planar structure for displaying indicia.

11. A tassel structure as claimed in claim 10 wherein said cooperating elements of a cord gripping means further comprises:

(a) said plug having upwardly opening pocket means formed in the top thereof; and (b) said shell having rib means depending from the top into the cavity thereof, said rib means being aligningly disposed in said pocket means of said plug for frictionally holding the ends of the draw cord in said pocket means of said plug.

12. A tassel structure as claimed in claim 10 wherein said socket means of said shell and said projection member means of said plug are wedge shaped.

13. A tassel structure as claimed in claim 10 wherein said cooperating elements of a cord grip means further comprises:

(a) said socket means of said shell being formed by a pair of ribs depending from the top into the cavity thereof, said pair of ribs being disposed on opposite sides of the aperture formed through the top of said shell and cooperating with adjacent portions of the side wall of said shell to provide a pair of sockets which provide said socket means of said shell;

(b) said plug having an upstanding central ridge on its top, said projection member means being in the form of a pair of upstanding projection members disposed on opposite sides and in spaced relationship with the central ridge to provide a pair of pockets on opposite sides of the ridge;

(c) each of said pair of ribs of said shell being aligningly disposed in different ones of the pockets of said plug for frictionally holding a first portion of each of the ends of the draw cord in different ones of said pair of pockets of said plug; and (d) each of said pair of projection members of said plug being aligningly disposed in different ones of said sockets of said shell for frictionally holding a second portion of each of the ends of the draw cord in different ones of said pair of sockets of said shell.

14. A tassel as claimed in claim 13 and further comprising said plug being formed with a pair of flats on diametrically opposed sides thereof to provide a pair of spaces between said flats of said plug and the adjacent portions of the side wall of said shell for frictionally wedging a third portion of each of the ends of the draw cord in different ones of said pair of spaces.

15. A tassel structure as claimed in claim 10 and further comprising releasable latching means formed in said shell and on said plug for demountably holding said plug in the inserted position within the cavity of said shell.

16. A tassel structure as claimed in claim 15 wherein said latching means comprises:

(a) said shell having a pair of openings formed in diametrically opposed locations in the side wall thereof; and (b) a pair of spring arms formed on diametrically opposed sides of said plug, each of said spring arms having a button-like enlargement extending therefrom, said pair of spring arms having normal positions wherein said button-like enlargements are located in different ones of the openings of said shell for holding said plug in said shell and having deflected positions wherein said button-like enlargements are free of the opening of said shell.

17. A tassel structure for mounting on the end of a cord comprising:

(a) a shell having a top and an endless side wall which define a cavity of frusto-conical configuration, said shell having an open bottom and an aperture formed axially through the top for receiving the end of the cord;

(b) a plug having a top and a bottom and being of frusto-conical configuration for insertion into the cavity of said shell through the open bottom thereof;

(c) cooperating elements of a cord gripping means formed in said shell and on said plug for frictionally gripping the end of the cord, said cooperating elements including, I. said plug having upwardly opening pocket means formed in the top thereof, II. said shell having rib means depending from the top into the cavity thereof, said rib means being aligningly disposed in said pocket means of said plug for frictionally holding a portion of the end of the cord in said pocket means of said plug, III. said shell having socket means formed in the top thereof so as to open downwardly into the cavity defined thereby, IV. upstanding projection member means formed on the top of said plug, said projection member means being aligningly disposed in said socket means of said shell for frictionally holding another portion of the end of the cord in said socket means of said shell; and (d) a disc of planar configuration mounted on the bottom of said plug for covering the bottom of said plug and the bottom of said shell and to provide a planar surface for displaying indicia.

18. A tassel structure as claimed in claim 17 wherein said socket means of said shell and said projection member means of said plug are wedge shaped.

19. A tassel as claimed in claim 17 and further comprising said plug being configured to provide a space between one side of said plug and the adjacent portion of the side wall of said shell for frictionally holding still another portion of the end of the cord in said space.

20. A tassel structure as claimed in claim 17 and further comprising releasable latching means formed in said shell and on said plug for demountably holding said plug in the inserted position within the cavity of said shell.

21. A tassel structure for joining the opposite ends of a draw cord comprising:

(a) a shell having a top and an endless side wall which define a cavity of frusto-conical configuration, said shell having an open bottom and an aperture formed axially through the top thereof for receiving the ends of the draw cord;

(b) a plug having a top and a bottom and being of frusto-conical configuration for linearly pushed insertion into the cavity of said shell through the open bottom thereof;

(c) cooperating elements of a cord gripping means formed in said shell and on said plug for frictionally gripping the ends of the draw cord, said cooperating elements including, I. said shell having socket means formed in the top thereof so as to open downwardly into the cavity defined thereby, II. upstanding projection member means formed on the top of said plug, said projection member means being aligningly disposed in said socket means of said shell for frictionally holding the ends of the draw cord in said socket means of said shell; and (d) releasable latching means formed in said shell and on said plug for demountably holding said plug in the inserted position within the cavity of said shell, said latching means including, I. said shell having a pair of opening formed in diametrically opposed locations in the side wall thereof, II. a pair of spring arms formed on diametrically opposed sides of said plug, each of said spring arms having a button-like enlargement extending therefrom, said pair of spring arms having normal positions wherein said button-like enlargements are located in different ones of the openings of said shell for holding said plug in said shell and having deflected positions wherein said button-like enlargements are free of the openings of said shell

* * * * *